US012434091B2

(12) United States Patent
Contreras et al.

(10) Patent No.: US 12,434,091 B2
(45) Date of Patent: Oct. 7, 2025

(54) MULTIFUNCTIONAL EXERCISE DEVICE AND METHOD OF USE

(71) Applicants: Bret Michael Contreras, Ft. Lauderdale, FL (US); Gregory Scott Olson, Owatonna, MN (US); Zachary Scott Olson, Owatonna, MN (US)

(72) Inventors: Bret Michael Contreras, Ft. Lauderdale, FL (US); Gregory Scott Olson, Owatonna, MN (US); Zachary Scott Olson, Owatonna, MN (US)

( * ) Notice: Subject to any disclaimer, the term of this patent is extended or adjusted under 35 U.S.C. 154(b) by 143 days.

(21) Appl. No.: 18/369,949

(22) Filed: Sep. 19, 2023

(65) Prior Publication Data

US 2025/0090896 A1 Mar. 20, 2025

(51) Int. Cl.

| | |
|---|---|
| ***A63B 21/00*** | (2006.01) |
| ***A63B 21/04*** | (2006.01) |
| ***A63B 21/055*** | (2006.01) |

(52) U.S. Cl.

CPC .... *A63B 21/4034* (2015.10); *A63B 21/00047* (2013.01); *A63B 21/0414* (2013.01); *A63B 21/0557* (2013.01); *A63B 2225/093* (2013.01)

(58) Field of Classification Search

CPC ..... A63B 21/4034; A63B 21/00047; A63B 21/0414; A63B 21/0557; A63B 21/4029; A63B 21/4027; A63B 21/4031; A63B 21/4039; A63B 21/4037; A63B 2225/093; A63B 23/04; A63B 23/0405; A63B 23/0482

See application file for complete search history.

(56) References Cited

U.S. PATENT DOCUMENTS

| | | | | |
|---|---|---|---|---|
| 5,405,306 | A * | 4/1995 | Goldsmith | A63B 23/03575 482/142 |
| 9,050,493 | B2 * | 6/2015 | Perez | A63B 21/16 |
| 10,486,020 | B2 * | 11/2019 | Sadikaj | A63B 69/0062 |
| 11,135,464 | B2 * | 10/2021 | Ballestero | A63B 23/0222 |
| 11,577,123 | B1 * | 2/2023 | Saffaie | A63B 23/0205 |
| 11,701,543 | B1 * | 7/2023 | Smith, Jr. | A63B 21/4033 482/104 |
| 11,794,058 | B2 * | 10/2023 | Ballestero | A63B 21/0552 |
| 12,076,608 | B2 * | 9/2024 | Peterson | A63B 23/0494 |
| 2017/0056708 | A1 * | 3/2017 | Kelly | A63B 23/0233 |
| 2020/0155892 | A1 * | 5/2020 | Grossman | A63B 21/4034 |
| 2021/0121726 | A1 * | 4/2021 | Potapov | A63B 21/4037 |
| 2022/0118308 | A1 * | 4/2022 | Park | A63B 21/00047 |
| 2023/0285833 | A1 * | 9/2023 | Mitchell | A63B 21/4034 |

* cited by examiner

*Primary Examiner* — Loan B Jimenez
*Assistant Examiner* — Kathleen M Fisk

(57) ABSTRACT

A multifunctional exercise device enabling performance of a plurality of exercises includes a base, an upright support, a first rest, and a second rest. The base has upper and lower surfaces, front and rear ends, and opposed lateral edges, which extend between the front and rear ends. The upright support has lower and upper ends, with the lower end being attached to the upper surface proximate to the rear end and the upright support extending substantially vertically from the base. The first and second rests are removably couplable to the upper end of the upright support for performing pluralities of first and second exercises, respectively. The first and second rests are elongated and each has a longitudinal axis extending bilaterally and perpendicularly from the upright support in parallel with a vertical plane that bisects each of the opposed lateral edges. The second rest is rotatable about its longitudinal axis.

14 Claims, 9 Drawing Sheets

MULTIFUNCTIONAL EXERCISE DEVICE AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to exercise devices and more particularly pertains to a new exercise device enabling performance of a plurality of exercises. Many exercise devices, such as Nordic Ham Curl exercise devices, are dedicated to a particular exercise and are not adaptable to allow users to perform additional exercises. Adaptable exercise devices that can be used for multiple exercises are desirable to reduce overall costs and space requirements.

(2) Description of Related Art Including Information Disclosed Under 37 CFR 1.97 and 1.98

The prior art relates to Nordic Ham Curl exercise devices but which are not adaptable to allow a user to perform hip thrust exercises.

(h) BRIEF SUMMARY OF THE INVENTION

An embodiment of the disclosure meets the needs presented above by generally comprising a base, an upright support, a first rest, and a second rest. The base has an upper surface, a lower surface, a front end, a rear end, and opposed lateral edges, which extend between the front end and the rear end. The upright support has a lower end and an upper end, with the lower end being attached to the upper surface proximate to the rear end and the upright support extending substantially vertically from the base. The first rest is removably couplable to the upper end of the upright support for performing a plurality of first exercises. The first rest is elongated and having a longitudinal axis, which extends bilaterally and perpendicularly from the upright support in parallel with a vertical plane that bisects each of the opposed lateral edges. The second rest is removably couplable to the upper end of the upright support. The second rest also is elongated and has a longitudinal axis that extends bilaterally and perpendicularly from the upright support in parallel with the vertical plane that bisects each of the opposed lateral edges. The second rest is rotatable about its longitudinal axis for performing a plurality of second exercises.

Another embodiment of the disclosure includes a method of performing multiple exercises, which entails provision of a multifunctional exercise device, according to the disclosure above. Steps of the method include inserting the attachment rods of the first rest into the attachment tubes, coupling the first couplers to the second couplers to secure the first rest to the upright support, positioning the second rest atop and across the pair of siderails, and performing respective first exercises, such as Nordic Ham Curls. Additional steps include detaching the first rest from the upright support, inserting the attachment rods of the second rest into the attachment tubes, coupling the first couplers to the second couplers to secure the second rest to the upright support, and performing respective second exercises, such as hip thrusts.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
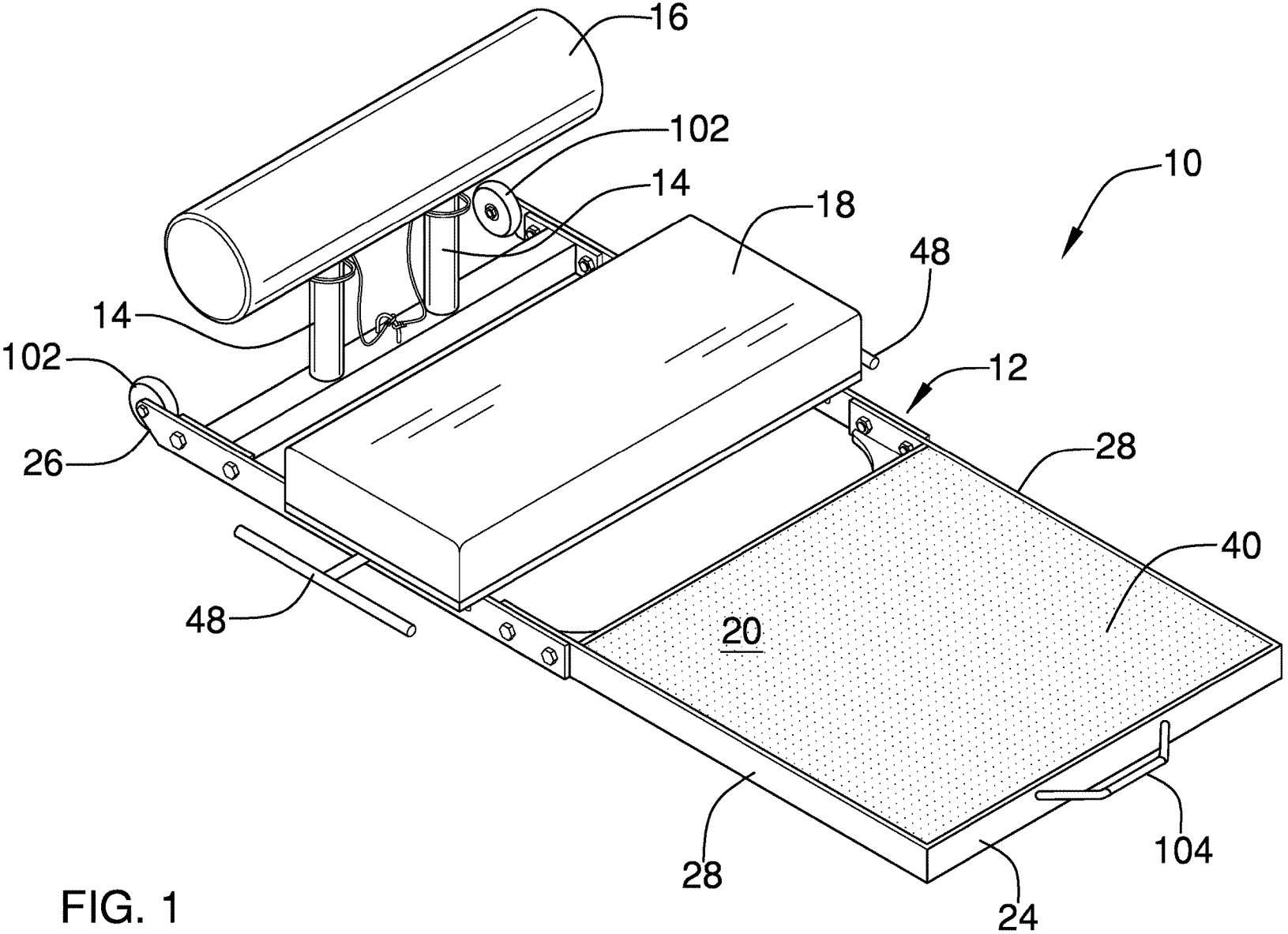
FIG. 1 is a top isometric perspective view of a multifunctional padding device according to an embodiment of the disclosure.

With reference now to the drawings, and in particular to FIGS. 1 through 10 thereof, a new exercise device embodying the principles and concepts of an embodiment of the disclosure and generally designated by the reference numeral 10 will be described.

As best illustrated in FIGS. 1 through 10, the multifunctional exercise device 10 generally comprises a base 12, an upright support 14, a first rest 16, and a second rest 18. The base 12 has an upper surface 20, a lower surface 22, a front end 24, a rear end 26, and opposed lateral edges 28, which extend between the front end 24 and the rear end 26. The upright support 14 has a lower end 30 and an upper end 32, with the lower end 30 being attached to the upper surface 20 proximate to the rear end 26 and the upright support 14 extending substantially vertically from the base 12.

Figure 3:
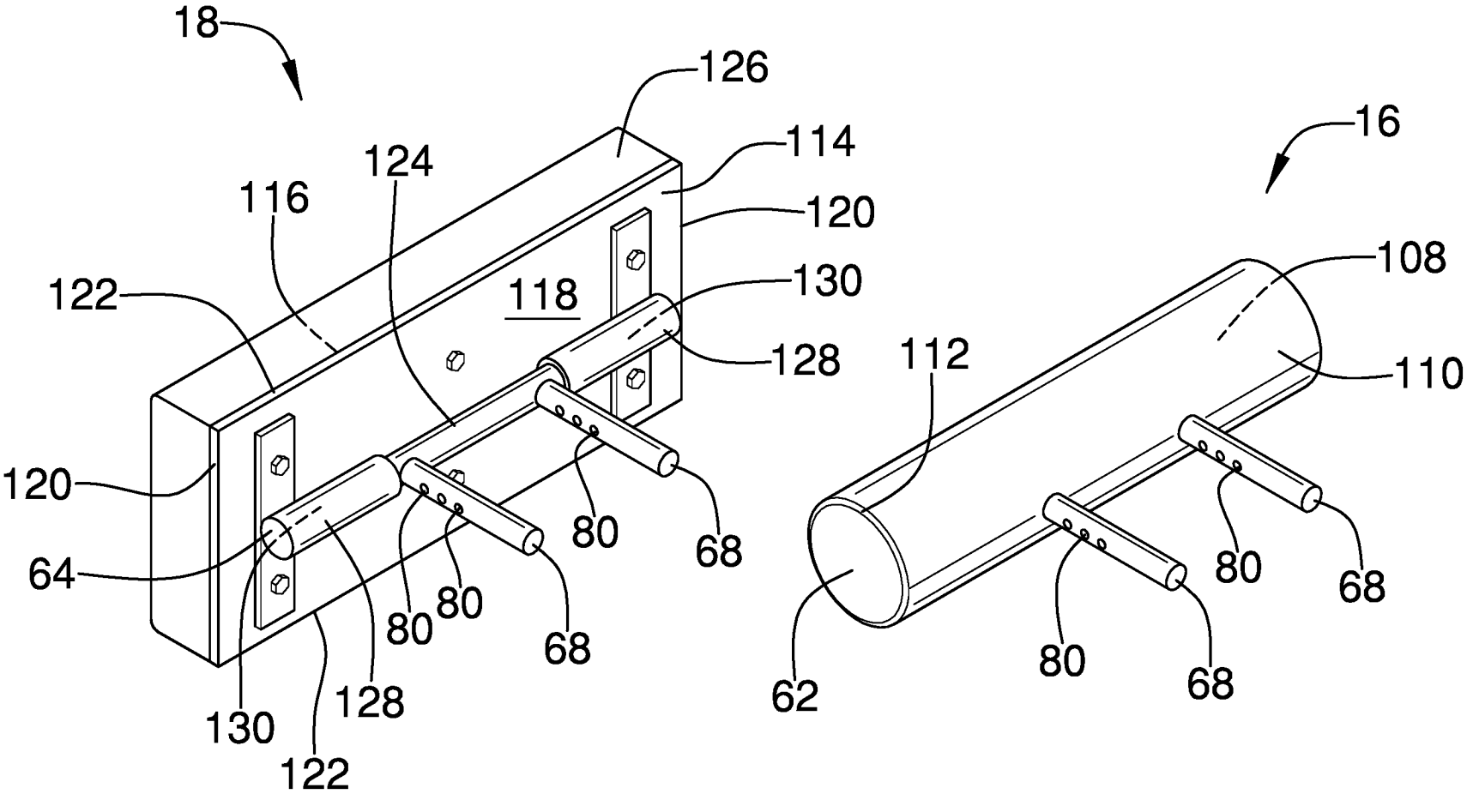
FIG. 3 is a bottom isometric perspective view of an embodiment of the disclosure.
Figure 4:
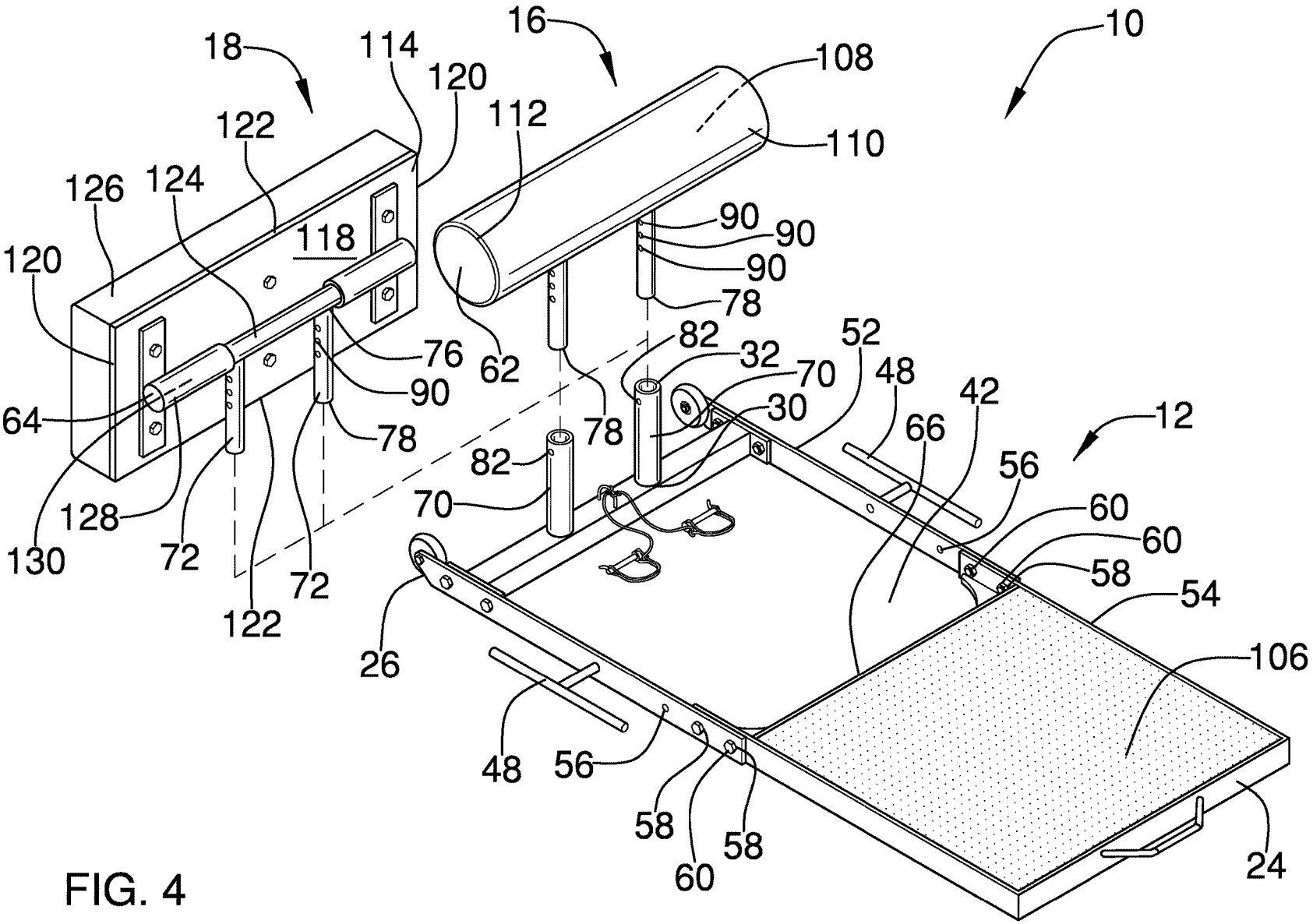
FIG. 4 is an exploded view of an embodiment of the disclosure.

The base 12 comprises a pair of siderails 34, which define the opposed lateral edges 28 of the base 12, a rear rail 36, and a front rail 38. The rear rail 36 is attached to and extends between the siderails 34 proximate to the rear end 26. As is shown in FIGS. 3 and 4, the upright support 14 is attached to the rear rail 36 equally distant from the siderails 34. The front rail 38 is attached to and extends between the siderails 34 and defines the front end 24 of the base 12. A footrest 40 is attached to and extends between the siderails 34 of the pair of siderails 34 adjacent to the front end 24. The footrest 40, the rear rail 36, and the pair of siderails 34 define a void 42 in the base 12.

Other configurations of the base 12 are anticipated by the present invention. For example, the base 12 may not be rectangular, as is shown in the figures. Additionally, one or both of the footrest 40 and the front rail 38 may be deleted and the siderails 34 may not be parallel.

The footrest 40 may comprise a plurality of crossbeams 44 and a foot plate 46. The crossbeams 44 are attached to and extend between the siderails 34. The foot plate 46 is attached to the plurality of crossbeams 44. The foot plate 46 is anticipated to comprise metal, wood, plastic, or the like, and comprise an upper layer 106 of rubber, silicone, or the like, to increase traction.

Figure 9:
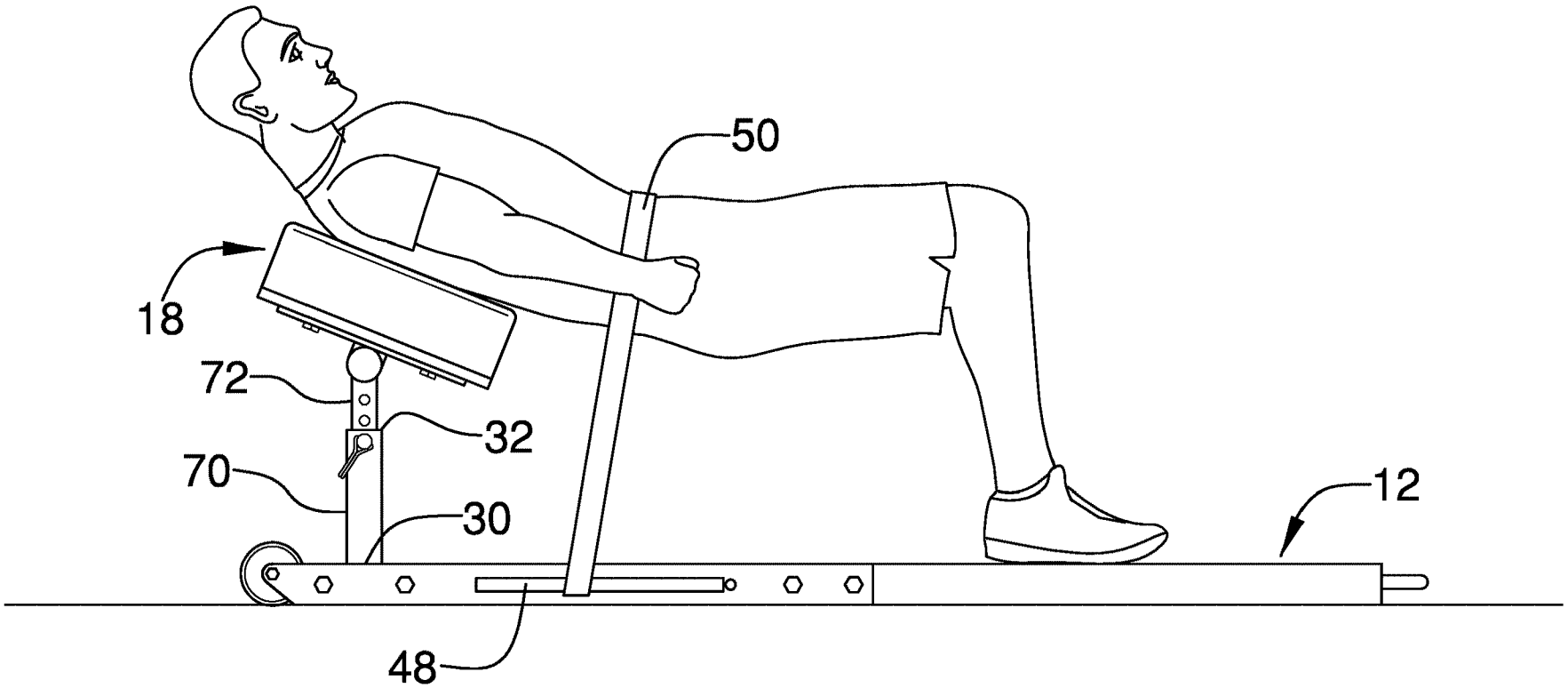
FIG. 9 is an in-use view of an embodiment of the disclosure.
Figure 10:
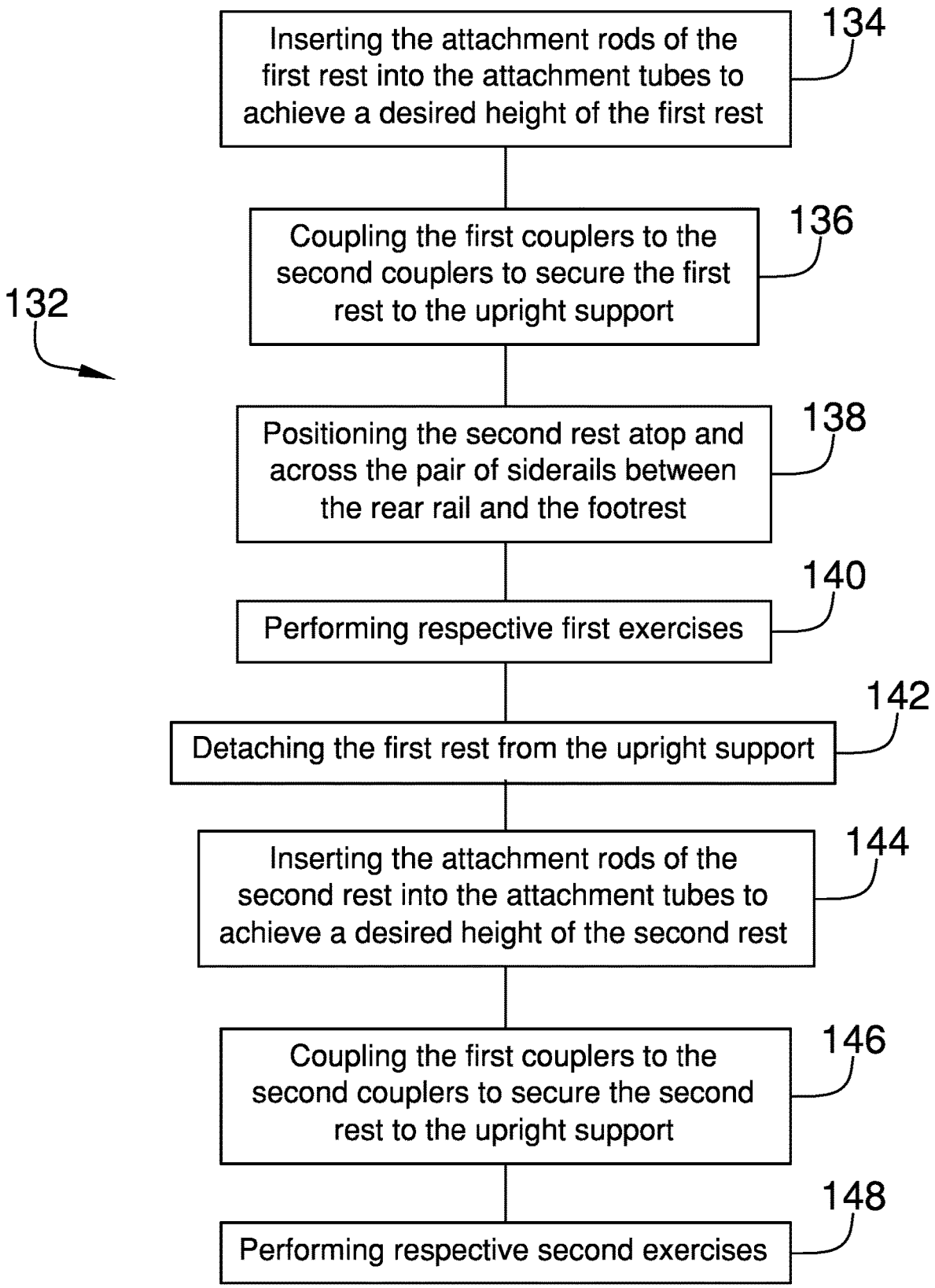
FIG. 10 is a flow diagram for a method utilizing an embodiment of the disclosure.

Each T-bar 48 of a pairs of T-bars 48 is attached to and extends from a respective siderail 34. The pair of T-bars 48 is configured for attachment of one or more resistance bands 50. As will become apparent below, the resistance bands 50 can be utilized in the performance of a variety of exercises with the multifunctional exercise device 10, one example of which is depicted in FIG. 9.

Figure 5:
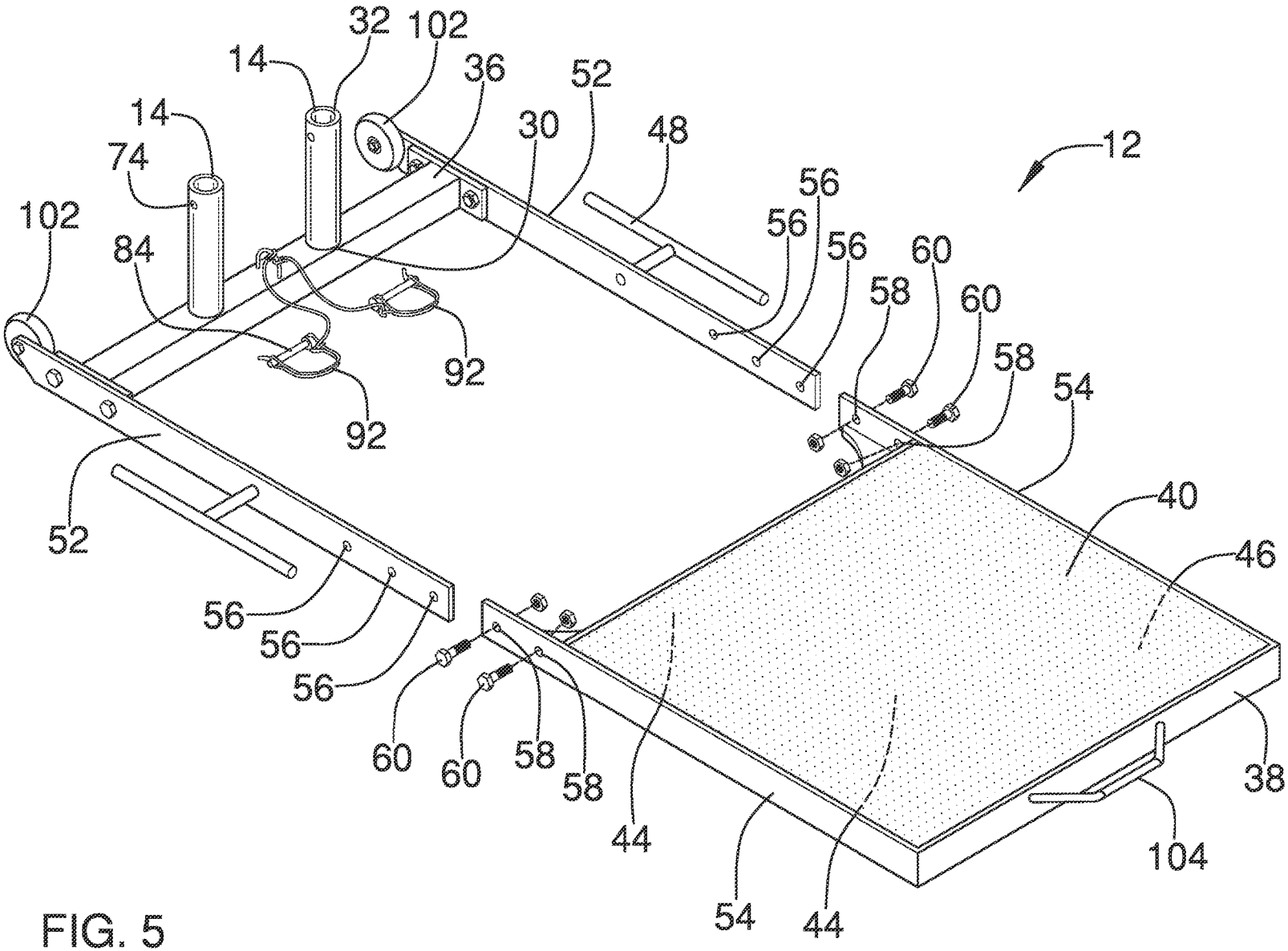
FIG. 5 is an exploded view of an embodiment of the disclosure.

As is shown in FIG. 5, each siderail 34 comprises a rear section 52 and a front section 54. The rear rail 36 is attached to and extends between the rear sections 52. The footrest 40 is attached to and extends between the front sections 54. The front sections 54 are selectively positionable along and removably securable to the rear sections 52 so that the footrest 40 is selectively positionable relative to the rear rail 36, thereby allowing for adjustment of the base 12 to fit users having a variety of heights.

One example of a length adjustment means for the base 12 is depicted in the figures, wherein the rear section 52 and the front section 54 have a set of first securing holes 56 and a set of second securing holes 58 positioned therein, respectively, enabling selective alignment of respective second securing holes 58 with respective first securing holes 56 with the footrest 40 being positioned at a user selected distance from the rear rail 36. Each fastener 60, such as a bolt, of a plurality of fasteners 60 is insertable through a respective second securing hole 58 and an aligned first securing hole 56 to removably secure the front sections 54 to the rear sections 52.

While FIGS. 4 and 5 depict two positions for attachment of the front sections 54 to the rear sections 52, with the two positions representing approximately a 10.0 cm difference in positioning of the footrest 40 relative to the rear rail 36, the present invention anticipates additional positions for attachment of the front sections 54 to the rear sections 52. Additionally anticipated are front sections 54 and rear sections 52 comprised of square or round tubing, which are complementarily sized, such that, for example, the front sections 54 are selectively insertable to various depths into the rear sections 52 prior to being fixedly attached to the rear sections 52.

Figure 6:
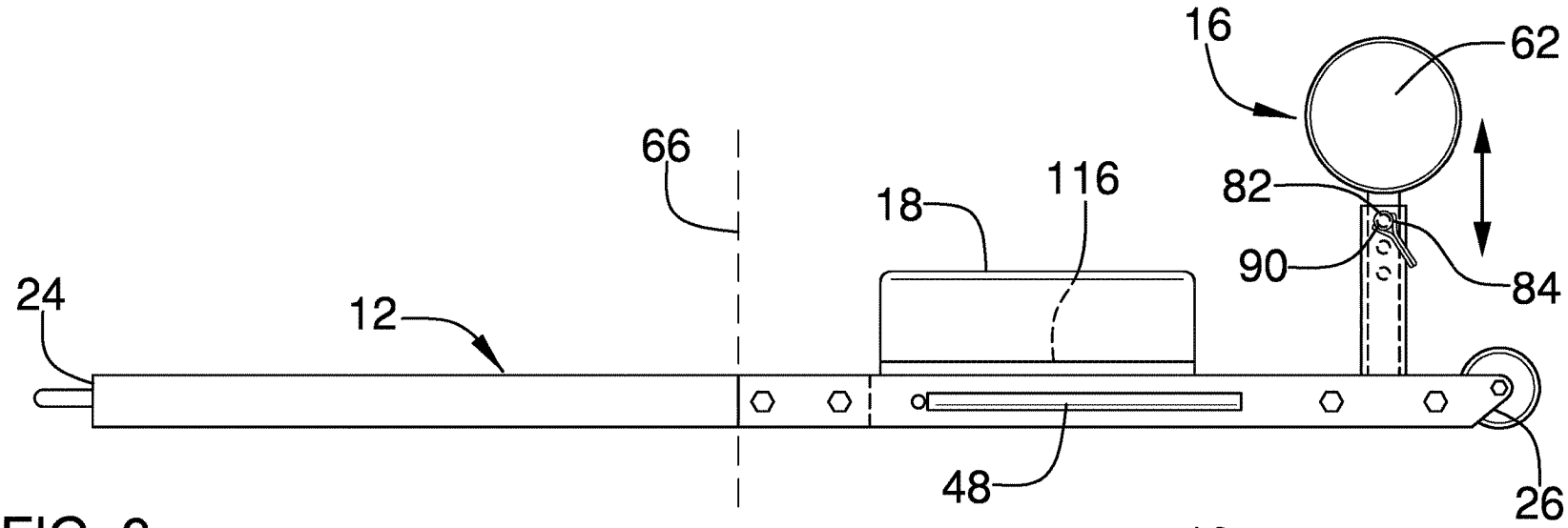
FIG. 6 is a side view of an embodiment of the disclosure.
Figure 7:
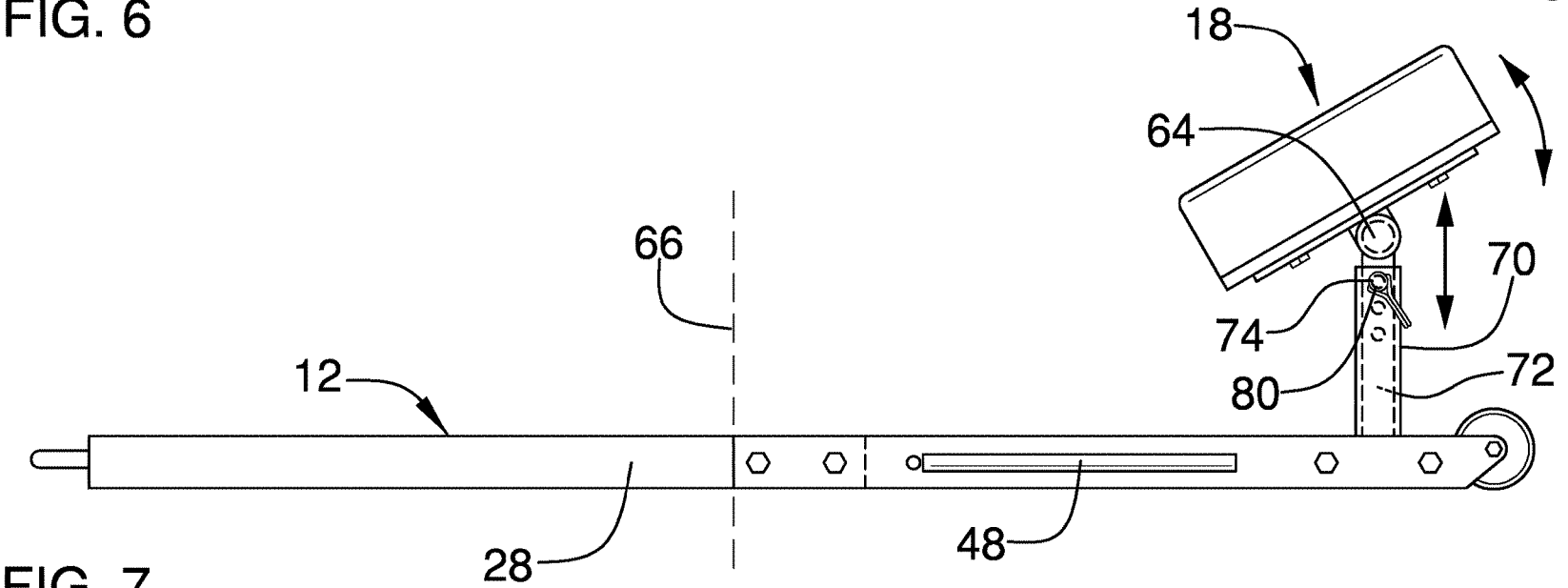
FIG. 7 is a side view of an embodiment of the disclosure.
Figure 8:
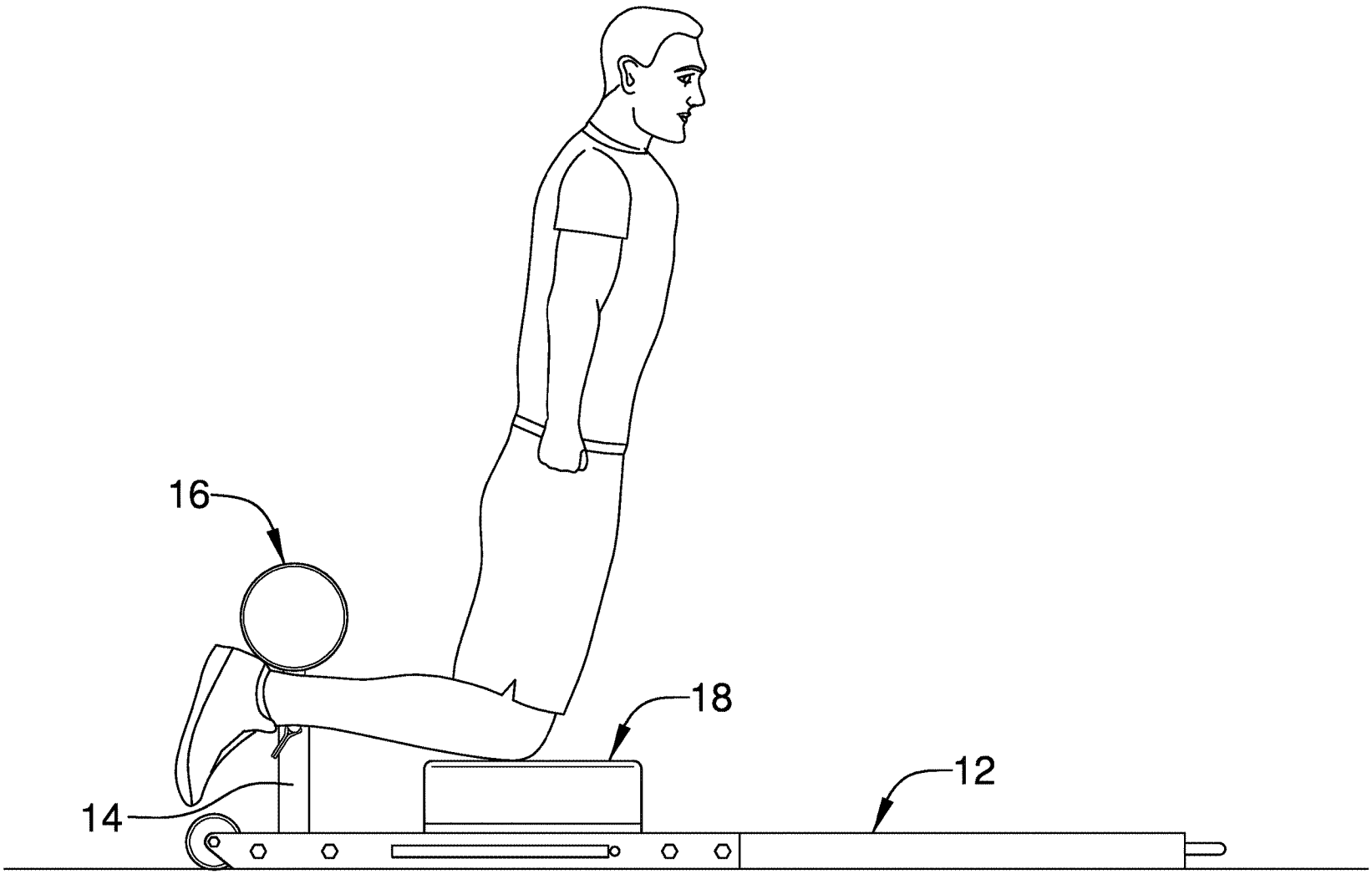
FIG. 8 is an in-use view of an embodiment of the disclosure.

The first rest 16 and the second rest 18 are removably couplable to the upper end 32 of the upright support 14 for performing a plurality of first exercises and a plurality of second exercises, respectively. Each of the first rest 16 and the second rest 18 is elongated and has a longitudinal axis (62 and 64, respectively), which extends bilaterally and perpendicularly from the upright support 14 in parallel with a vertical plane 66 that bisects each of the opposed lateral edges 28, as is shown in FIGS. 6 and 7. The second rest 18 is rotatable about its longitudinal axis 64 to enable the performance of the plurality of second exercises.

The present invention also anticipates the second rest 18 being selectively securable at a user selected degree of rotation about its longitudinal axis 64. Also anticipated by the present invention is a third rest (not shown), which also would be removably couplable to the upper end 32 of the upright support 14 and which would have a longitudinal axis extending bilaterally and perpendicularly from the upright support 14 in parallel with the vertical plane 66 bisecting each of the opposed lateral edges 28. While shaped similarly to the second rest 18, the third rest would not be rotatable about its longitudinal axis.

Each of the first rest 16 and the second rest 18 comprises an engagement member 68, which is removably couplable to the upright support 14 so that the first rest 16 and the second rest 18 are interchangeably couplable to the upright support 14. The upright support 14 may comprise a pair of attachment tubes 70 and each engagement member 68 may comprise a pair of attachment rods 72, as is shown in FIG. 4. Each pair of attachment rods 72 is selectively insertable into the pair of attachment tubes 70 to interchangeably secure the first rest 16 and the second rest 18 to the upright support 14.

The first couplers 74 of a pair of first couplers 74 are attached singly to the attachment tubes 70. Each attachment rod 72 has an upper terminus 76 and a lower terminus 78. A plurality of second couplers 80 is attached to the attachment rods 72 so that each attachment rod 72 is fitted with a set of second couplers 80 that extends from proximate to the upper terminus 76 to proximate to the lower terminus 78 of the attachment rod 72. The second couplers 80 are complementary to the first couplers 74 so that each first coupler 74 is positioned to selectively couple to a respective second coupler 80 to removably secure a respective one of the first rest 16 and the second rest 18 to the upright support 14 at a user selected height above the base 12. The first rest 16 and the second rest 18 thus can be positioned at a user selected height above the rear rail 36. This configuration allows the first rest 16 and the second rest 18 to be adjusted to users of a variety of heights. For example, the first rest 16 and the second rest 18 could be adjusted to heights of 36.8, 39.4, 41.9 and 44.4 cm above the surface upon which the base 12 is positioned to accommodate users of different heights.

Each first coupler 74 may comprise a pair of attachment holes 82 and a lock pin 84. The attachment holes 82 are opposingly positioned in a respective attachment tube 70. The lock pin 84 has a first end 86 and a second end 88 and is selectively insertable through the pair of attachment holes 82. Each second coupler 80 may comprise a channel 90, which extends through a respective attachment rod 72 and which is selectively alignable with the pair of attachment holes 82. The user thus is positioned to insert the lock pin 84 through the pair of attachment holes 82 and a respective channel 90 to removably secure the respective attachment rod 72 to the respective attachment tube 70. Additionally anticipated by the present invention are other securing means in place of the lock pins 84, such as, but not limited to, spring-loaded pins, which are attached to the attachment tubes 70 and which are selectively insertable into respective channels 90.

Each clip 92 of a pair of clips 92, which is C-shaped, has a first endpoint 94 and a second endpoint 96. The first endpoint 94 is hingedly attached to the first end 86 of a respective lock pin 84 and the second endpoint 96 of the clip 92 is securable to the respective lock pin 84 proximate to the second end 88 of the respective lock pin 84. The respective lock pin 84 thus is prevented from being inadvertently extracted from the pair of attachment holes 82 and the respective channel 90. For example, the clip 92 may be securable to the lock pin 84 by means of being resiliently deformable to allow positioning of a ring 98 attached to the clip 92 over the lock pin 84, or the clip 92 may include a cotter pin (not shown) that is insertable through a hole in the lock pin 84.

Figure 2:
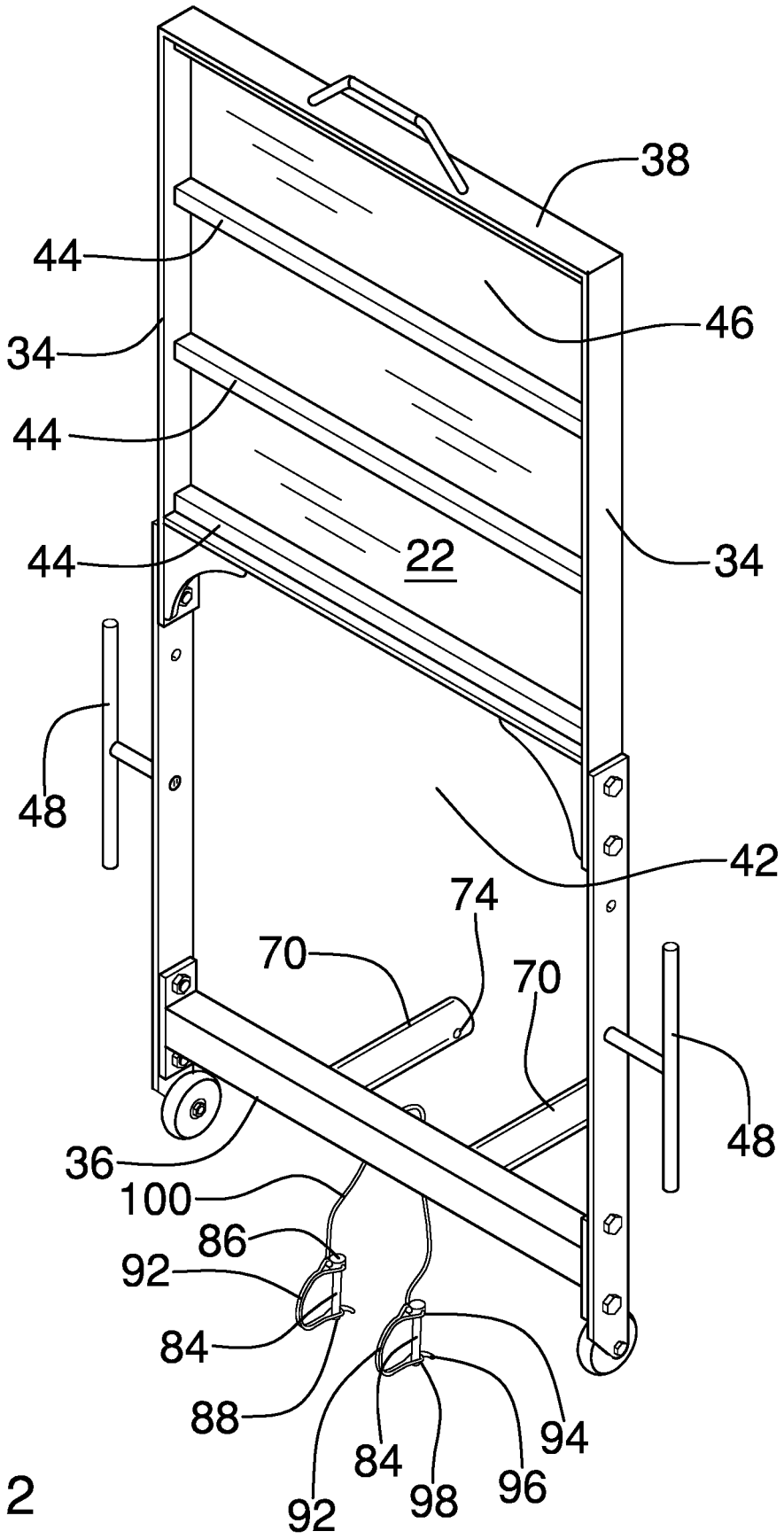
FIG. 2 is a bottom isometric perspective view of an embodiment of the disclosure.

The multifunctional exercise device 10 also may include a tether 100, which is attached to the clip 92 and which is attached to or attachable to the rear rail 36 to retain the clip 92 in proximity to the attachment tubes 70. As is shown in FIG. 2, a pair of wheels 102 and a handle 104 are attached to the rear rail 36 and to a front rail 38 of the base 12, respectively, to facilitate placement and stowage of the multifunctional exercise device 10.

The present invention anticipates the engagement members 68 and the upright support 14 having alternative configurations, such as, but not limited to, heavy duty hinges to which attachment rods 72 or attachment tubes 70 are attached. The attachment rods 72 may be cylindrical, although the present invention anticipates alternative configurations of the upright support 14 and the engagement member 68. In one example, the engagement member 68 could comprise one or two attachment rods 72 or attachment tubes 70 that have a rectangular cross-sectional profile. A single attachment rod 72 or attachment tube 70 of sufficient strength and having a rectangular cross-sectional profile would be sufficient to support the second rest 18 and the user and also would allow for easy alignment of the pair of attachment holes 82 with a respective channel 90. Additionally anticipated is both the attachment rods 72 and the attachment tubes 70 being tubular.

The first rest 16 comprises a horizontal pole 108, to which a respective pair of attachment rods 72 is attached with the attachment rods 72 extending in parallel from the horizontal pole 108. Padding 110 is attached to and positioned around the horizontal pole 108. The padding 110 has a cross-sectional profile 112, which is arcuate and which may be circular, as is shown in FIG. 3. Thus, when the first rest 16 is being used as a backrest or to cushion ankles while performing Nordic Ham Curls, the padding 110 having a cross-sectional profile 112 that is arcuate or circular provides more comfort than one wherein the cross-sectional profile 112 is rectangular. Additionally, the padding 110 is less subject to wear when it has a cross-sectional profile 112 that is arcuate or circular.

The second rest 18 comprises a rest plate 114, which has an upper face 116, a lower face 118, opposed edges 120, and opposed sides 122, and a horizontal rod 124. A top pad 126 is attached to and covers the upper face 116 of the rest plate 114. The top pad 126 and the padding 110 comprise materials well known to those skilled in the art of cushioning surfaces of exercise devices, such as foamed elastomer, silicone, rubber, fabric coverings, and the like. The horizontal rod 124 is rotatably attached to the lower face 118 of the rest plate 114 so that the rest plate 114 is rotatable around the longitudinal axis 64 of the second rest 18.

A pair of end tubes 128 is attached to the lower face 118 of the rest plate 114. The horizontal rod 124 has opposed end segments 130 that are positioned in the pair of end tubes 128 so that the horizontal rod 124 is rotatably attached to the rest plate 114. As is shown in FIGS. 3, 4, and 7, the horizontal rod 124 is positioned equally distant from the opposed sides 122 of the rest plate 114. A respective pair of attachment rods 72 is attached to and extends in parallel from the horizontal rod 124. The rest plate 114 and the top pad 126 are configured to support and to cushion, respectively, a back of the user while the user is performing respective second exercises, during which the second rest 18 moves coincidently with the back of the user.

The second exercises that are enabled to be performed comfortably using the multifunctional exercise device 10 include, but are not limited to, double leg hip thrusts, single leg hip thrusts, barbell hip thrusts, and the like. Additionally, the T-bars 48 can be used with one or more of the resistance bands 50 to enable additional second exercises, such as, but not limited to, hip banded hip thrusts, as is being demonstrated in FIG. 9, banded barbell hip thrusts, knee banded hip thrusts and the like. Hip thrust exercises, which cannot be safely or properly performed on prior art Nordic Ham Curl exercise devices, are widely recognized as the most effective way to increase the strength and the size of the gluteus maximus for enhanced sports performance.

With the first rest 16 being removably secured to the upright support 14, the second rest 18 is positionable atop and across the pair of siderails 34 to cushion knees of the user who is performing respective first exercises. The second rest 18 thus is configured to cushion knees of a user who is performing a Nordic Ham Curl exercise on the multifunctional exercise device 10, as is being demonstrated in FIG. 8 and which also is referred to as Nordic ham curl or a Nordic hamstring curl. The third rest (not shown) would have shorter attachment rods 72 than the second rest 18, allowing the third rest to be positioned atop and across the siderails 34 as per the second rest 18. The present invention also anticipates the rest plate 114 and the top pad 126 being dimensioned so as to fit between the siderails 34 within the void 42.

While typically rectangular, the present invention anticipates the rest plate 114 having opposed edges 120 that are convexly arcuate, with the top pad 126 being shaped complimentarily to the rest plate 114. The opposed edges 120 being convexly arcuate would eliminate sharp corners which could potentially cause injury or discomfort upon contact. The present invention anticipates the opposed edges 120 being separated by from 50.0 to 92.0 cm and the opposed sides 122 of the rest plate 114 being separated by from 20.0 to 56.0 cm, with the rest plate 114 and the top pad 126 having a combined height measuring from 2.0 to 18.0 cm. Typically, the opposed edges 120 would be separated by from 65.0 to 75.0 cm, the opposed sides 122 of the rest plate 114 would be separated by from 27.0 to 33.0 cm, and the combined height of the rest plate 114 and the top pad 126 would measure from 12.0 to 16.0 cm.

In use, the multifunctional exercise device 10 enables a method of performing multiple exercises 132, which entails provision of a multifunctional exercise device 10, according to the specification above. A first step 134 of the method 132 is inserting the attachment rods 72 of the first rest 16 into the attachment tubes 70 to achieve a desired height of the first rest 16. A second step 136 of the method 132 is coupling the first couplers 74 to the second couplers 80 to secure the first rest 16 to the upright support 14. A third step 138 of the method 132 is positioning the second rest 18 atop and across the pair of siderails 34 between the rear rail 36 and the footrest 40. A fourth step 140 of the method 132 is performing respective first exercises, such as Nordic Ham Curls.

A fifth step 142 of the method 132 is detaching the first rest 16 from the upright support 14. A sixth step 144 of the method 132 is inserting the attachment rods 72 of the second rest 18 into the attachment tubes 70 to achieve a desired height of the second rest 18. A seventh step 146 of the method 132 is coupling the first couplers 74 to the second couplers 80 to secure the second rest 18 to the upright support 14. An eighth step 148 of the method 132 is performing respective second exercises, such as hip thrusts.

In the embodiment wherein the front sections 54 are selectively positionable along and securable to the rear sections 52 to adjust the base 12 to fit users having a variety of heights, the method 132 comprises the additional setup steps of positioning the front sections 54 along the rear sections 52 to achieve the user selected distance of the footrest 40 from the rear rail 36, aligning respective second securing holes 58 with respective first securing holes 56, and inserting a fastener 60 through each respective second securing hole 58 and an aligned first securing hole 56 to removably secure the front sections 54 to the rear sections 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A multifunctional exercise device comprising:

a base having an upper surface, a lower surface, a front end, a rear end, and opposed lateral edges extending between the front end and the rear end;

an upright support having a lower end and an upper end, the lower end being attached to the upper surface proximate to the rear end such that the upright support extends substantially vertically from the base;

a first rest removably couplable to the upper end of the upright support for performing a plurality of first exercises, the first rest being elongated and having a longitudinal axis extending bilaterally and perpendicularly from the upright support in parallel with a vertical plane bisecting each of the opposed lateral edges;

a second rest removably couplable to the upper end of the upright support, the second rest being elongated and having a longitudinal axis extending bilaterally and perpendicularly from the upright support in parallel with the vertical plane bisecting each of the opposed lateral edges, the second rest being rotatable about the longitudinal axis of the second rest for performing a plurality of second exercises;

wherein the base comprises:

a pair of siderails defining the opposed lateral edges of the base;

a rear rail attached to and extending between the siderails of the pair of siderails proximate to the rear end, the upright support being attached to the rear rail equally distant from the siderails of the pair of siderails;

a front rail attached to and extending between the siderails of the pair of siderails and defining the front end of the base; and a footrest attached to and extending between the siderails of the pair of siderails adjacent to the front end, such that the footrest, the rear rail, and the pair of siderails define a void in the base;

wherein each of the first rest and the second rest comprise an engagement member, the engagement members being removably couplable to the upright support, such that the first rest and the second rest are interchangeably couplable to the upright support;

wherein the upright support comprises a pair of attachment tubes;

wherein each engagement member comprises a pair of attachment rods, such that each pair of attachment rods is selectively insertable into the pair of attachment tubes to interchangeably couple the first rest and the second rest to the upright support;

wherein the first rest comprises:

a horizontal pole, the respective pair of attachment rods being attached to and extending in parallel from the horizontal pole; and padding being attached to and positioned around the horizontal pole;

wherein the second rest comprises:

a rest plate having an upper face and a lower face;

a horizontal rod being rotatably attached to the lower face of the rest plate, such that the rest plate is rotatable around the longitudinal axis of the second rest;

the respective pair of attachment rods being attached to and extending in parallel from the horizontal rod; and a top pad being attached to and covering the upper face of the rest plate, wherein the rest plate and the top pad are configured to support and to cushion, respectively, a back of the user while performing respective second exercises, during which the second rest moves coincidently with the back of the user; and the first rest being removably secured to the upright support, the second rest is positionable atop and across the pair of siderails for cushioning knees of the user while performing respective first exercises.

2. The multifunctional exercise device of claim 1, further including:

a pair of first couplers being attached singly to the attachment tubes;

each attachment rod having an upper terminus and a lower terminus; and a plurality of second couplers being attached to the attachment rods, such that each attachment rod is fitted with a set of second couplers extending from proximate to the upper terminus to proximate to the lower terminus of the attachment rod, the second couplers being complementary to the first couplers, such that each first coupler is positioned for selectively coupling to a respective second coupler to removably secure a respective one of the first rest and the second rest to the upright support at a user selected height above the base.

3. The multifunctional exercise device of claim 2, wherein:

each first coupler comprises:

a pair of attachment holes opposingly positioned in a respective attachment tube; and a lock pin having a first end and a second end and being selectively insertable through the pair of attachment holes; and each second coupler comprises a channel extending through a respective attachment rod, such that a respective channel is selectively alignable with the pair of attachment holes, positioning the user for inserting the lock pin through the pair of attachment holes and a respective channel to removably secure the respective attachment rod to the respective attachment tube.

4. The multifunctional exercise device of claim 3, further including a pair of clips, each clip of the pair of clips being C-shaped and having a first endpoint and a second endpoint, the first endpoint being hingedly attached to the first end of a respective lock pin, the second endpoint of the clip being securable to the respective lock pin proximate to the second end of the respective lock pin, such that the respective lock pin is prevented from being extracted from the pair of attachment holes and the respective channel.

5. A method of performing multiple exercises using the multifunctional exercise device according to claim 2, the method comprising:

inserting the attachment rods of the first rest into the attachment tubes to achieve a desired height of the first rest;

coupling the first couplers to the second couplers to secure the first rest to the upright support;

positioning the second rest atop and across the pair of siderails between the rear rail and the footrest;

performing respective first exercises;

detaching the first rest from the upright support;

inserting the attachment rods of the second rest into the attachment tubes to achieve a desired height of the second rest;

coupling the first couplers to the second couplers to secure the second rest to the upright support; and performing respective second exercises.

6. The method of claim 5, further including:

each siderail of the pair of siderails comprising;

a rear section having a set of first securing holes positioned therein, the rear rail being attached to and extending between the rear sections; and a front section, the footrest being attached to and extending between the front sections, the front sections being selectively positionable along the rear sections, such that the footrest is selectively positionable relative to the rear rail for adjusting the base to fit users having a variety of heights, the front section having a set of second securing holes positioned therein enabling selective alignment of a respective second securing holes with respective first securing holes with the footrest positioned at a user selected distance from the rear rail;

a plurality of fasteners, each fastener being insertable through a respective second securing hole and an aligned first securing hole for removably securing the front sections to the rear sections; and the method comprising the additional setup steps of:

positioning the front sections along the rear sections to achieve the user selected distance of the footrest from the rear rail;

aligning respective second securing holes with respective first securing holes; and inserting a respective one of the fasteners through each respective second securing hole and an aligned first securing hole to removably secure the front sections to the rear sections.

7. The multifunctional exercise device of claim 1, wherein each siderail of the pair of siderails comprises:

a rear section, the rear rail being attached to and extending between the rear sections; and a front section, the footrest being attached to and extending between the front sections, the front sections being selectively positionable along and removably securable to the rear sections, such that the footrest is selectively positionable relative to the rear rail for adjusting the base to fit users having a variety of heights.

8. The multifunctional exercise device of claim 7, further including:

each rear section having a set of first securing holes positioned therein;

each front section having a set of second securing holes positioned therein enabling selective alignment of respective second securing holes with respective first securing holes with the footrest positioned at a user selected distance from the rear rail; and a plurality of fasteners, each fastener being insertable through a respective second securing hole and an aligned first securing hole for removably securing the front sections to the rear sections.

9. The multifunctional exercise device of claim 1, wherein the footrest comprises:

a plurality of crossbeams attached to and extending between the siderails; and a foot plate attached to the plurality of crossbeams.

10. The multifunctional exercise device of claim 1, wherein the rest plate is substantially rectangular.

11. The multifunctional exercise device of claim 1, further including a pair of end tubes attached to the lower face of the rest plate, the horizontal rod having opposed end segments positioned in the pair of end tubes, such that the horizontal rod is rotatably attached to the rest plate.

12. The multifunctional exercise device of claim 1, wherein the horizontal rod is positioned equally distant from opposed sides of the rest plate.

13. The multifunctional exercise device of claim 1, wherein the attachment rods of each pair of attachment rods are cylindrical.

14. The multifunctional exercise device of claim 1, further including a pair of T-bars, each T-bar of the pairs of T-bars being attached to and extending from a respective siderail of the pair of siderails, wherein the pair of T-bars is configured for attachment of one or more resistance bands for performing respective second exercises.

* * * * *